United States Patent [19]

Yokosuka et al.

[11] Patent Number: 4,913,175

[45] Date of Patent: Apr. 3, 1990

[54] LIQUID-APPLYING TIP ASSEMBLY

[75] Inventors: Takehiko Yokosuka; Osami Yamauchi; Hiroshi Kato, all of Aichi, Japan

[73] Assignee: Pilot Ink Co., Ltd., Aichi, Japan

[21] Appl. No.: 256,262

[22] Filed: Oct. 12, 1988

Related U.S. Application Data

[63] Continuation of Ser. No. 886,849, Jul. 18, 1986, abandoned.

[30] Foreign Application Priority Data

| | | | |
|---|---|---|---|
| Jul. 19, 1985 | [JP] | Japan | 60-111713[U] |
| Nov. 27, 1985 | [JP] | Japan | 60-182439[U] |
| Nov. 27, 1985 | [JP] | Japan | 60-182440[U] |

[51] Int. Cl.[4] ..... A45D 40/24

[52] U.S. Cl. ..... 132/317; 132/218; 401/199; 401/206; 401/273; 401/278; 401/284

[58] Field of Search ..... 132/317, 318; 401/206, 401/199, 260, 264, 273, 278, 284

[56] References Cited

U.S. PATENT DOCUMENTS

| | | | |
|---|---|---|---|
| 2,624,902 | 1/1953 | Soldner | 401/206 |
| 3,479,122 | 11/1969 | Funahashi | 401/199 |
| 3,640,631 | 2/1972 | Sotir | 401/206 |
| 3,947,137 | 3/1976 | Hori | 401/217 |
| 4,364,684 | 12/1982 | Kohno et al. | 401/206 |
| 4,370,989 | 2/1983 | Taylor | 132/79 |
| 4,496,258 | 1/1985 | Tanaka et al. | 401/206 |
| 4,509,876 | 4/1985 | Hori | 401/217 |
| 4,609,300 | 9/1986 | Robert | 401/122 |
| 4,792,252 | 12/1988 | Kremer et al. | 401/206 |

FOREIGN PATENT DOCUMENTS

| | | | |
|---|---|---|---|
| 3303341 | 2/1984 | Fed. Rep. of Germany | 401/260 |
| 2502067 | 9/1982 | France | 401/225 |
| 80467 | 5/1982 | Japan | 401/260 |
| 732982 | 7/1955 | United Kingdom | 401/225 |
| 2146588 | 4/1985 | United Kingdom | 401/260 |

*Primary Examiner*—Robert Peshock
*Assistant Examiner*—Michael Lynch
*Attorney, Agent, or Firm*—Sughrue, Mion, Zinn, Macpeak & Seas

[57] ABSTRACT

In a liquid-applying tip assembly in which the liquid-applying member is pushed to operate the valve to allow the liquid to flow to the liquid-applying member, the liquid-applying member is a plastic member which comprises: a plurality of ribs extending radially and axially from an axial core in such a manner as to form a plurality of axial liquid passageways therebetween. A barrier is provided between the valve and the cylinder of the tip assembly, the barrier having a hole whose diameter is slightly larger than the outside diameter of the liquid-applying member to control the flow of liquid.

4 Claims, 2 Drawing Sheets

LIQUID-APPLYING TIP ASSEMBLY

This is a continuation of prior application Ser. No. 06/886,849 filed on July 18, 1986, abandoned.

BACKGROUND OF THE INVENTION

1. Field of the Invention

This invention relates to the tip assembly of a liquid-applying tool (hereinafter referred to as "a liquid applying tip assembly"). More particularly, it relates to the tip assembly of a liquid applying tool in which the end of a liquid applying member protruding from a cylinder is pushed to operate a valve to cause cosmetic liquids such as manicure liquids and eye liner liquids or somewhat viscous liquids such as paints, marking solutions, character correcting solutions, or plastic model assembling adhesive to flow out of the tip assembly.

2. Background Art

Examples of the conventional liquid-applying tip assembly of this type are a bundle of fibers covered with plastic material, a bundle of fibers covered with resin, or a porous material.

In the case of the bundle of fibers covered with plastic material, the fibers are liable to become separated. This difficulty may be eliminated by using a bundle of fibers covered with resin or employing a porous material. However, in the case where cosmetic liquids containing pigment having a high specific gravity or a large grain size or being relatively high in viscosity are used intermittently for a long period, the capillary gaps are liable to become clogged with the pigment. Also, coating solutions may manifest decreased color tone, density or covering characteristics by the filtering effect when they flow from the liquid-applying tip assembly. This difficulty may be eliminated by increasing the size of the capillary gaps. However, in this case, the fibers are liable to come off, and the rigidity of the porous material is decreased. In addition, the liquid-applying tip assembly is not strong enough to apply the liquid to a given area.

On the other hand, in a conventional liquid applying tool of the type in which a valve is operated to supply coating solution from the liquid storing chamber, it is common practice to provide a porous material such as sponge in front of the valve mechanism so that the coating solution flowing through the valve is blocked and temporarily stored in the porous material and is then supplied to the liquid-applying member. The liquid-applying member is then generally made of fibers covered with resin and is relatively large in diameter (cf. FIG. 12). In the conventional liquid applying tool, the porous material used to block the flow of liquid has low elasticity, and is dimensionally unstable, thus being rather difficult to assemble. In the case where it is required to use a liquid-applying member small in diameter, it is essential that the liquid-applying member is supported along the central axis of the liquid-applying tool with high accuracy. However, this requirement cannot be satisfied by the above-described porous material, because the porous material has insufficient supported strength and poor dimensional stability.

In the case of a liquid-applying member small in diameter, especially one in which ribs are formed on the axial core in such a manner that they extend along the axis of the axial core to form liquid passage therebetween, it is difficult to apply a suitable quantity of liquid to the liquid passage to thereby stably dispense the liquid.

SUMMARY OF THE INVENTION

An object of the invention is to eliminate the above-described difficulties accompanying a conventional liquid-applying tip assembly.

The foregoing object and other objects of the invention have been achieved by the provision of a liquid-applying tip assembly in which the end of a liquid-applying member protruding from a cylinder is pushed to operate the valve of a valve mechanism provided behind the liquid-applying member. The operation of the valve causes the liquid in a liquid reservoir to flow forwardly to the liquid applying member to thereby permit the application of the liquid. According to the invention, the liquid-applying member is a plastic member which comprises an axial core and a plurality of ribs extending radially from the periphery of the axial core in such a manner as to form a plurality of liquid passages between the ribs, which also extend along, the axis of the axial core. A barrier is provided between the valve and the end of the cylinder, the barrier having a hole whose diameter is substantially equal to the outside diameter of the liquid-applying member to adjust the flow of liquid.

The nature, principle and utility of the invention will become more apparent from the following detailed description and the appended claims when read in conjunction with the accompanying drawings.

BRIEF DESCRIPTION OF THE DRAWINGS

In the accompanying drawings.

DETAILED DESCRIPTION OF THE PREFERRED EMBODIMENTS

Figure 1:
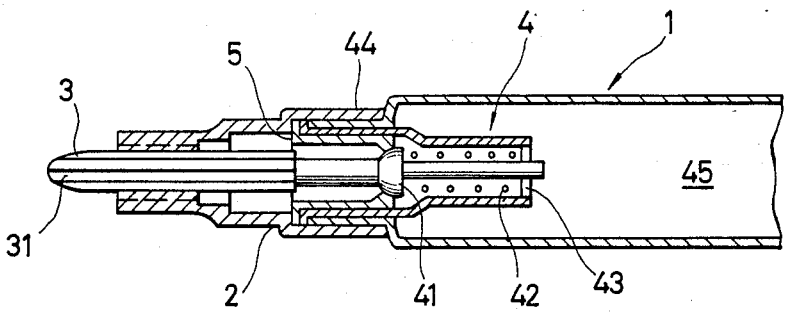
FIG. 1 is a sectional view of a first example of a liquid-applying tip assembly according to this invention.
Figure 2:
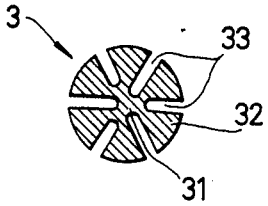
FIGS. 2, 3 and 4 are cross-sectional views of examples of a liquid-applying member in the liquid-applying tip assembly according to the invention.
Figure 3:
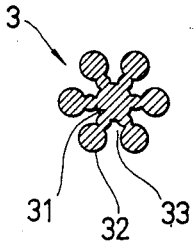
Figure 4:
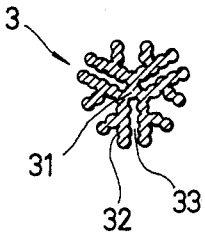

A first example of a liquid-applying tip assembly according to this invention is of the type that, as shown in FIG. 1, the end of a liquid-applying member 3 protruding from a cylinder 2 is pushed to operate the valve 41 of a valve mechanism 4 provided behind the liquid-applying member 3. Actuation of the valve 41 causes the liquid in a rear liquid reservoir 45 to flow forwardly through holes 43 and through the valve 41 to the liquid-applying member 3 so that the application of liquid can be achieved. In the liquid-applying tip assembly 1, according to the invention, the liquid-applying member 3 is a plastic member which comprises, as shown in FIGS. 2, 3 and 4 an axial core 31 and a plurality of ribs 32 extending radially from the periphery of the axial core 31 and also extending axially along the core 31 in such a manner as to form a plurality of liquid passages 33 between the ribs 32. Also, the liquid-applying tip assembly has a barrier 5 with a hole whose diameter is substantially equal to the outside diameter of the liquid-applying member 3, in order to control the flow of liquid.

FIGS. 2, 3 and 4 show examples of the cross-section of the fluid-applying member 3. The width of the liquid passages 33 is not limited to the value at which the capillary action of the liquid occurs. That is, it may be 1 to 2 mm for instance according to the viscosity of liquid to be applied.

For reference only, an example of a method of manufacturing the liquid-applying member 3 will be described. Molten thermoplastic resin is extruded from a die having a plurality of holes arranged adjacent to one another, to form a plurality of filaments. The filaments thus formed are brought into contact with one another while their surfaces are adhesive, to form the liquid-applying member. This method particularly applies to the liquid-applying member 3 (FIGS. 3 and 4). The liquid-applying member 3 shown in FIG. 2 may be effectively formed by injection molding.

In the above-described liquid-applying tip assembly, the axial core 31 has both a suitably high rigidity and durability. The ribs 32 extending from the axial core 31 form the liquid passages 33, which permits the elastic deformation of the liquid-applying member 3. That is, the liquid-applying member 3 is made flexible and restorable so that its tip be snugly fitted on a surface to be applied with liquid. Accordingly, it goes without saying that the liquid-applying member 3 is useful for the coloring of thin lines, small surfaces and border lines. In the case where it is required to color a relatively large surface, the liquid-applying member can be so deformed as to be suitable for coloring the surface by adjusting the writing pressure. By removing the pressure, the liquid-applying member 3 is restored to its former configuration. Thus, any lines or surfaces can be colored with the liquid applying tip assembly by controlling the writing pressure.

As was described before, the liquid passages 33 are in the form of grooves which extend along the axis of the axial core. Therefore, the width of the liquid passages 33 is always changed by the writing pressure, so that the liquid is dynamically held in the liquid passages 33. This can substantially eliminate the difficulties that arise in the cases where the liquid-applying member is a conventional molded member having capillary gaps, a fiberous article or a sponge. In these cases, a cosmetic solution with pigments of high specific gravity or large grain size or being relatively highly viscous clogged the capillary gaps with pigment when the pen is intermittently used for a long period. Perhaps, the flow of the cosmetic solution is completely blocked. Even when the capillary gaps are clogged up with the pigment, this difficulty can be eliminated by immersing the liquid-applying member 3 in the solvent or washing it therewith. This washing is effective since the liquid passages are exposed on the circumferential periphery.

The effect of the liquid-applying member 3 according to the invention is obtained in combination with the flow controlling effect of the barrier 5 which is provided between the valve 41 and the end portion of the cylinder 2. In FIG. 1, the barrier 5 is a plastic cylinder, its rear portion being a valve seat 44. The barrier has a hole whose diameter is slightly larger than the outside diameter of the liquid applying member 3. The plastic cylinder or barrier 5 in this case is a part of the valve mechanism 4.

Figure 5:
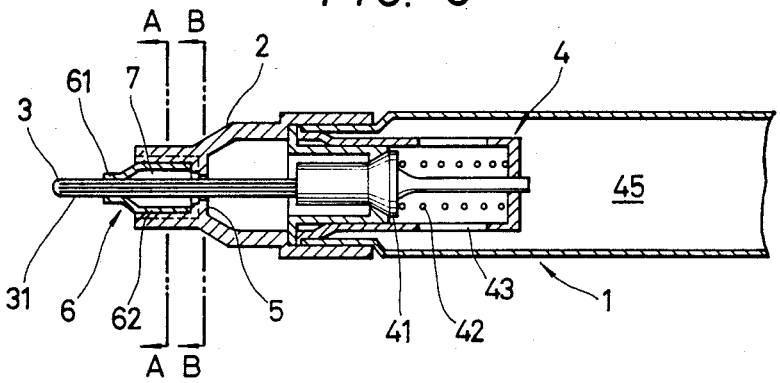
FIG. 5 is a sectional view of a second example of the liquid-applying tip assembly according to the invention.
Figure 6:
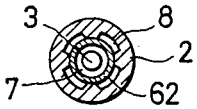
FIG. 6 is a cross-sectional view taken along line A—A in FIG. 5.
Figure 7:
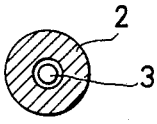
FIG. 7 is a cross-sectional view taken along line B—B in FIG. 5.
Figure 8:
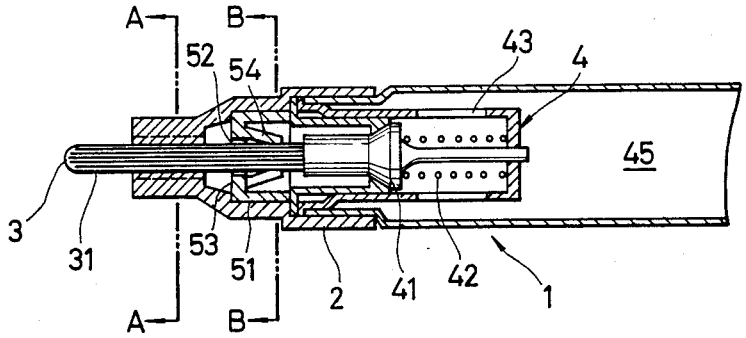
FIG. 8 is a sectional view of a third example of the liquid-applying tip assembly according to the invention.
Figure 9:
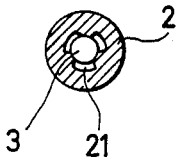
FIG. 9 is a cross-sectional view taken along line A—A in FIG. 8.

FIG. 5 shows a second example of the liquid-applying tip assembly according to the invention, in which a special member is employed with respect to the barrier 5 to improve the flow of the painting solution. FIG. 8 shows a third example of the liquid-applying tip assembly according to the invention, in which a plastic molded article serves as a barrier 5 and also supports the liquid-applying member 3.

In the liquid-applying tip assembly of FIG. 5, a cylindrical holder 6 is provided between the end portion of a cylinder 2 and a barrier 5 which is provided between a valve 41 and the end portion of the cylinder 2. The holder 6 comprises a front part 61 whose inside diameter is substantially equal to the outside diameter of the liquid-applying member 3, and a rear part 62 whose inside diameter is larger than the inside diameter at the front.. The liquid-applying member 3 is slidably inserted into the holder 6. A liquid storing small annular reservoir 7 is formed between the outer wall of the liquid-applying member 3 and the inner wall of the rear part 62. The small annular reservoir 7 communicates with capillary air exchanging passages 8 formed between the outer wall of the rear part 62 of the holder 6 and the inner wall of the cylinder 2 of the tip assembly.

The cylindrical holder 6 is made of plastic or metal material in such a manner that, as was described above, the small annular reservoir 7 is formed between the outer wall of the liquid-applying member 3 and the inner wall of the rear part 62 and communicates with the air exchanging passages 8.

The barrier 5 has a hole whose diameter is slightly larger than the outside diameter of the liquid-applying member 3, as was described above. The valve mechanism 41 is so designed that the valve 41 is biased by a spring 42. More specifically, the structure of the valve mechanism may be a conventional one in which the valve 41 is operated by pushing the liquid-applying member 3 to control the flow of liquid.

The liquid-applying member 3 is passed through the hole of the front part 61 of the holder and the hole of the barrier 5 and connected to the rod of the valve 41. These holes support the liquid-applying member 3 in such a manner that the liquid-applying member 3 is slid on the central axis of the tip assembly to operate the valve 41. When the valve 41 is opened, the liquid flows out. However, the barrier 5 prevents the liquid from excessively flowing forward. The liquid passages 31 of the liquid-applying member 3 allow the liquid to be located inside the liquid-applying member<3 or to be held on its surface or to move the liquid to its end portion by capillary action. Of the liquid thus moved, the expressive amount of liquid which cannot be held by the liquid-applying member 3 is temporarily stored in the small annular reservoir 7 so that it is used later. The liquid stored in the small annular reservoir 7 is held within by the sealing action of the inner wall of the holder front part 61, the inner wall of the barrier 5, and the outer wall of the liquid-applying member 3 so that it is stably stored therein and used effectively at the time of liquid application.

The air in the tip assembly is circulated through the air exchanging passages 8 which are in the form of capillary tubes communicating with the previously mentioned small annular reservoir 7. The passages 8 receive the liquid which cannot be held by the small annular reservoir 7 connected with the passages 8. In this operation, the capillary action prevents the leakage of the liquid from the end of the liquid-applying member 3. The liquid in the small annular reservoir 7 is suitably held around the liquid-applying member 3. More specifically, it is held around the interior end portion of the liquid-applying member 3. Therefore, it can effectively supplement the flow of liquid as it is consumed.

Figure 10:
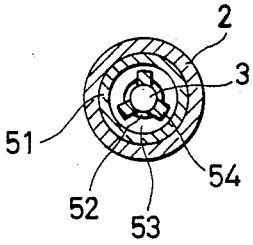
FIG. 10 is a cross-sectional view taken along line B—B in FIG. 8.
Figure 11:
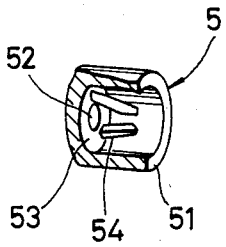
FIG. 11 is a perspective view, with parts cut away, of showing a plastic-molded member 5.
Figure 12:
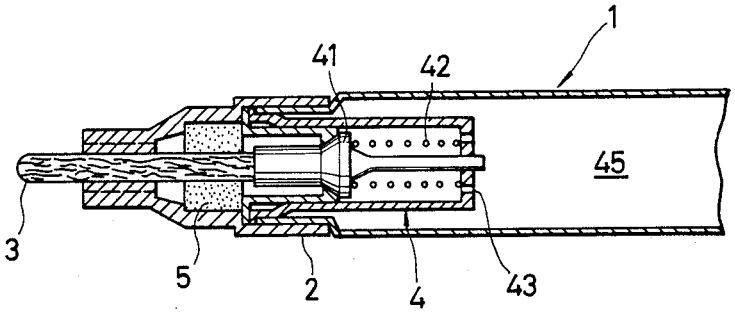
FIG. 12 PRIOR ART
FIG. 12 is a sectional view of a conventional liquid-applying tip assembly.

FIG. 8 shows a third example of the liquid-applying tip assembly according to the invention, in which a special plastic molded member 5 is employed as its barrier. The molded member 5 improves not only the operability and the ease of assembling the liquid-applying member 3, but also the liquid application characteristics of the liquid-applying member 3. The molded member 5, as shown in further detail in FIGS. 10 and 11, comprises the integral parts of a cylindrical wall 51, a protrusion 53 which protrudes radially inward from the inner cylindrical wall 51 (and which has a central hole 52 whose diameter is slightly larger than the outside diameter of the liquid-applying member 3) and a plurality of holding pieces 54 extending form the protrusion 53 in the backward axial direction. The liquid-applying member 3 is inserted into the central hole 52, and the rear portion of the liquid-applying member 3 thus inserted is elastically held by the holding pieces 54 so that the molded member 5 is slidably supported along the axis of the tip assembly.

As was described above, the liquid-applying member 3 is inserted into the central hole 52 formed in the protrusion 53 of the plastic molded member 5. In this operation, a small gap is formed between the liquid-applying member 3 and the wall of the central hole 52. The small gap thus formed, having a liquid sealing function, prevents the liquid from flowing forwardly. The holding pieces 54 extending from the periphery of the central hole 52 have their inner surfaces (preferably the inner surface of the rear end portions of the holding pieces 54) brought into elastical contact with the rear end portion of the liquid-applying member 3 so as to support the liquid-applying member 3 in such a manner that the member 3 is slidable in the axial direction and so as to guide the member 3 to the front end face of the valve rod of the valve 41.

The holding pieces 54 are spaced from the inner wall of the cylinder 51 of the plastic molded member 5 so that they serve as elastic members with the protrusion 53 as their common fulcrum.

The plastic molded member 5 can be formed by injection molding thermoplastic resin.

In the valve mechanism 4, the valve 41 is urged by the spring 42 so that the valve 4 is operated by pushing the end of the liquid-applying member 3.

What is claimed is:

1. A liquid-applying member;

a hollow cylinder;

a liquid-applying member protruding forwardly from said cylinder;

a reservoir for a liquid disposed behind said liquid-applying member;

a valve mechanism having a valve disposed between said liquid-applying member and said reservoir, said valve operable by rearward motion of said liquid-applying member to allow a flow of said liquid from said reservoir to said liquid-applying member; and a non-porous barrier disposed between said valve and said front portion of said hollow cylinder and having a central aperture through which said liquid-applying member passes, said aperture having a diameter slightly larger than an outside diameter of said liquid-applying member;

wherein said liquid-applying member comprises;

an axial core; and a plurality of ribs in an axial direction of said core and extending radially from said core, a plurality of axial flow passages for said liquid being formed on the circumferential periphery of said axial core between said ribs along the entire length thereof, each of said plurality of ribs comprising, in cross section, a plurality of convex arcuate portions in contact with each other, and said liquid-applying member being made of thermoplastic resin, wherein said barrier controls a flow of said liquid from said reservoir and slidably supports said liquid-applying member, in which said liquid-applying member is elastically deformed to change a writing width and to change a width of each of said plurality of axial flow passages by adjusting a writing pressure so that said liquid is dynamically held in said axial flow passage to be prevented from clogging therein.

2. A assembly as recited in claim 1, further comprising a holder disposed at least partially inside said hollow cylinder forwardly of said barrier, said holder comprising:

a front hollow cylindrical part having an inside diameter substantially equal to said outside diameter of said liquid-applying member;

a rear hollow cylindrical part having an inside diameter larger than said outside diameter of said liquid-applying member;

said front and rear hollow cylindrical parts being coaxial and said liquid-applying member being axially slidably disposed inside said front and rear hollow cylindrical parts;

a second reservoir being found between said rear cylindrical part and said liquid applying member;

capillary-tube-shaped air exchanging passages being formed between an exterior wall of said rear cylindrical part and an interior wall of said hollow cylinder, said passages being in flow communication with said second reservoir.

3. A tip assembly as recited in claim 1, wherein said barrier is an integral member comprising:

a first hollow cylindrical part;

an annular protrusion extending radially inward from said first hollow cylindrical part and having a central aperture substantially equal to and slightly larger than said outside diameter of said liquid-applying member; and a plurality of elastic holding pieces extending axially from said protrusion for radially inwardly supporting said liquid-applying member;

wherein said liquid-applying member is axially slidably disposed through said aperture of said protrusion and between said holding pieces.

4. A tip assembly as recited in claim 3, wherein said barrier consists of a plastic molded member.

* * * * *